US007413193B2

(12) United States Patent
Cacas

(10) Patent No.: US 7,413,193 B2
(45) Date of Patent: Aug. 19, 2008

(54) METHOD OF AND APPARATUS FOR GAMING

(75) Inventor: Clay T. Cacas, 15595 Longspur La., Terrell, TX (US) 75160

(73) Assignee: Clay T. Cacas, Terrell, TX (US)

( * ) Notice: Subject to any disclaimer, the term of this patent is extended or adjusted under 35 U.S.C. 154(b) by 332 days.

(21) Appl. No.: 11/292,663

(22) Filed: Dec. 2, 2005

(65) Prior Publication Data

US 2006/0082058 A1 Apr. 20, 2006

Related U.S. Application Data

(63) Continuation-in-part of application No. 11/039,181, filed on Jan. 20, 2005, now abandoned, which is a continuation-in-part of application No. 10/860,398, filed on Jun. 3, 2004, now abandoned, which is a continuation of application No. 10/403,275, filed on Apr. 1, 2003, now abandoned.

(51) Int. Cl.
*A63F 9/04* (2006.01)

(52) U.S. Cl. ..... 273/274; 273/146

(58) Field of Classification Search ..... 273/274, 273/309, 146

See application file for complete search history.

(56) References Cited

U.S. PATENT DOCUMENTS 4,060,246 A 11/1977 Ward ..... 273/135
4,506,890 A 3/1985 Murry ..... 463/22
4,887,819 A 12/1989 Walker ..... 273/256
4,902,019 A 2/1990 Berman ..... 273/256
5,133,559 A 7/1992 Page ..... 273/274
5,413,351 A 5/1995 Franklin ..... 273/274
5,512,850 A 4/1996 Mo ..... 327/108
5,513,850 A 5/1996 Vancura ..... 273/274
5,662,330 A 9/1997 Spears ..... 273/274
5,728,002 A 3/1998 Hobert ..... 463/17
5,788,240 A 8/1998 Feinberg ..... 273/274
5,791,651 A 8/1998 Bryant ..... 273/274
5,829,749 A 11/1998 Hobert ..... 273/274
5,964,463 A 10/1999 Moore, Jr. ..... 273/274
6,074,720 A 6/2000 Van Stratum ..... 428/41.4
6,102,403 A 8/2000 Kaufman ..... 273/292

(Continued)

OTHER PUBLICATIONS

"Craps", European And Asian Games, Syd Helprin, Gambling Times Incorporated, pp. 99-118, 1986.

(Continued)

*Primary Examiner*—Benjamin H Layno
(74) *Attorney, Agent, or Firm*—Michael A. O'Neil

(57) ABSTRACT

An otherwise conventional craps table comprises a segment with an alternative betting option to the traditional "Big 6" and "Big 8" wagers. One embodiment provides a low portion which allows a player to wager that a two, three, four, five, or six will be thrown on the next roll of the dice during play of a craps game and a high portion which allows a player to wager that an eight, a nine, ten, eleven, or twelve will thrown on the next roll of the dice during play of a craps game. The payout received by a wagering player is determined according to the bet placed and the method by which the desired numbers are thrown on the next roll.

7 Claims, 10 Drawing Sheets

U.S. PATENT DOCUMENTS

| | | | | |
|---|---|---|---|---|
| 6,176,489 | B1 | 1/2001 | Astancha | 273/274 |
| 6,257,579 | B1 | 7/2001 | Horan | 273/274 |
| 6,257,580 | B1 | 7/2001 | Brown | 273/274 |
| 6,302,395 | B1 | 10/2001 | Astancha | 273/274 |
| 6,328,305 | B1 | 12/2001 | Yuan | 273/274 |
| 6,378,869 | B1 | 4/2002 | Hedge, Jr. et al. | 273/274 |
| 6,648,756 | B2 | 11/2003 | Moody | 463/18 |
| 6,854,732 | B2 | 2/2005 | Moody | 273/146 |
| 6,913,262 | B2 | 7/2005 | Berman | 273/292 |
| 2001/0042960 | A1 | 11/2001 | Lewis et al. | 273/274 |
| 2002/0043766 | A1 | 4/2002 | Berman | 273/292 |
| 2003/0107172 | A1 | 6/2003 | Moody | 273/146 |
| 2005/0212213 | A1 | 9/2005 | Inglese | 273/292 |

OTHER PUBLICATIONS

Dice and Their Many Games, Scarne's Encyclopedia of Games, John Scarne, pp. 454-464.

Book entitled "Scarne on Dice", by John Scarne, copyrighted 1945 & 1946, p. 113.

METHOD OF AND APPARATUS FOR GAMING

CROSS-REFERENCE TO RELATED APPLICATIONS

This application is a continuation-in-part application of application Ser. No. 11/039,181, filed Jan. 20, 2005, now abandoned, the entire contents of which are incorporated herein by reference, which is a continuation-in-part application of application Ser. No. 10/860,398 filed Jun. 3, 2004, abandoned, which is a continuation of application Ser. No. 10/403,275 filed Apr. 1, 2003, abandoned.

TECHNICAL FIELD

This invention relates generally to games of chance and more particularly to improvements in the gaming activity known as craps.

BACKGROUND AND SUMMARY OF THE INVENTION

As is well known to those skilled in the art, the gaming activity known as craps is a table game, that is, craps is played on a gaming table as opposed to a gaming machine. Gaming machines which emulate the craps table game are also known, and the present invention is equally applicable thereto.

Craps differs from other table games in that the bets or wagers which are available to the player are clearly delineated on the craps table. Stated conversely, the only bets that can be made in the game of craps are identified with and stated on segregated areas of the craps table. In order to make a bet, a craps player places a selected number of chips on the segment of the craps table corresponding to the selected bet, whereupon the bet is made.

Referring to FIG. 1 of the drawings, there is shown a conventional craps table 10. As stated above, all of the bets or wagers that are possible in the game of craps are clearly stated on the craps table 10 and are associated with a particular designated segment thereof. Thus, if a player wishes to place a "COME" bet, the player places one or more chips in one of the segments 12 of the craps table 10 at the designated time during play of the craps game.

Having particular reference to the segments 14 of the craps table 10, two of the bets which are disfavored by craps players are known as "Big 6" and "Big 8". The "Big 6" and "Big 8" bets are generally referred to in the industry as "sucker bets" because the odds of winning these bets favor the house to a much greater extent as compared to other bets or wagers which are available on the craps table 10. Also, the payout resulting from a winning "BIG 6" or "BIG 8" is considered inadequate by most craps players.

Although a wager favoring the house might at first seem advantageous to the operator of the craps table 10, in the long run this is not the case. Thus, although a novice might occasionally make a "Big 6" or "Big 8" wager, the player will not do so again upon learning that the odds pertaining to such a bet so strongly favor the house. Therefore, because the areas of the craps table 10 associated with the "Big 6" and "Big 8" wagers go virtually unused, the areas 14 of the crap table 10 represent wasted space which does not earn revenue for the operator of the craps table 10.

The present invention comprises an improvement in the game of craps which overcomes the foregoing and other difficulties which have long since characterized the prior art. In accordance with the invention, one or more segments of the craps table heretofore associated with the bets known as "Big 6" and "Big 8" are replaced with different betting or waging opportunities which are much more favorable to the player. Alternatively, some craps tables may already have the "Big 6" and "Big 8" betting options removed, in which case the present invention comprises additional betting opportunities than those already presented on the craps table. The assignment of the portion of the craps table to betting opportunities more favorable to the player is ultimately advantageous to the operator of the craps table in that craps tables incorporating the present invention will attract additional players as compared with conventional craps tables not incorporating the present invention. Thus, because all bets or wagers available in the game of craps ultimately favor the house to a greater or lesser degree, operators of craps tables incorporating the present invention will ultimately realize increased revenues as opposed to operators of conventional craps tables.

Having particular reference to the segment 16 of the craps table 10, another bet with odds favoring the house, but popular among craps players is betting the "Hardways." The "Hardways" wagers that the Shooter must roll either a double two, double three, double four, or double five, resulting in a hard four, six, eight, or ten respectively, before a seven is rolled. If the shooter rolls the selected "hard" number in doubles, the payoff is high for the player, specifically a ten-to-one payout. However, if the selected number is rolled in a combination other than doubles, the player loses the bet.

In accordance with another embodiment of the present invention, there is provided a different wagering opportunity for a player to wager that a "hard" number will be thrown, but where the bet is not lost if the selected number is thrown in a combination other than doubles. This provides a better betting alternative to the player, because the only throw that defeats the bet is a seven, and may be referred to as a "Softways" bet.

BRIEF DESCRIPTION OF THE DRAWINGS

A more complete understanding of the present invention may be had by reference to the following Detailed Description when taken in connection with the accompanying Drawings, wherein.

DETAILED DESCRIPTION

Figure 1:
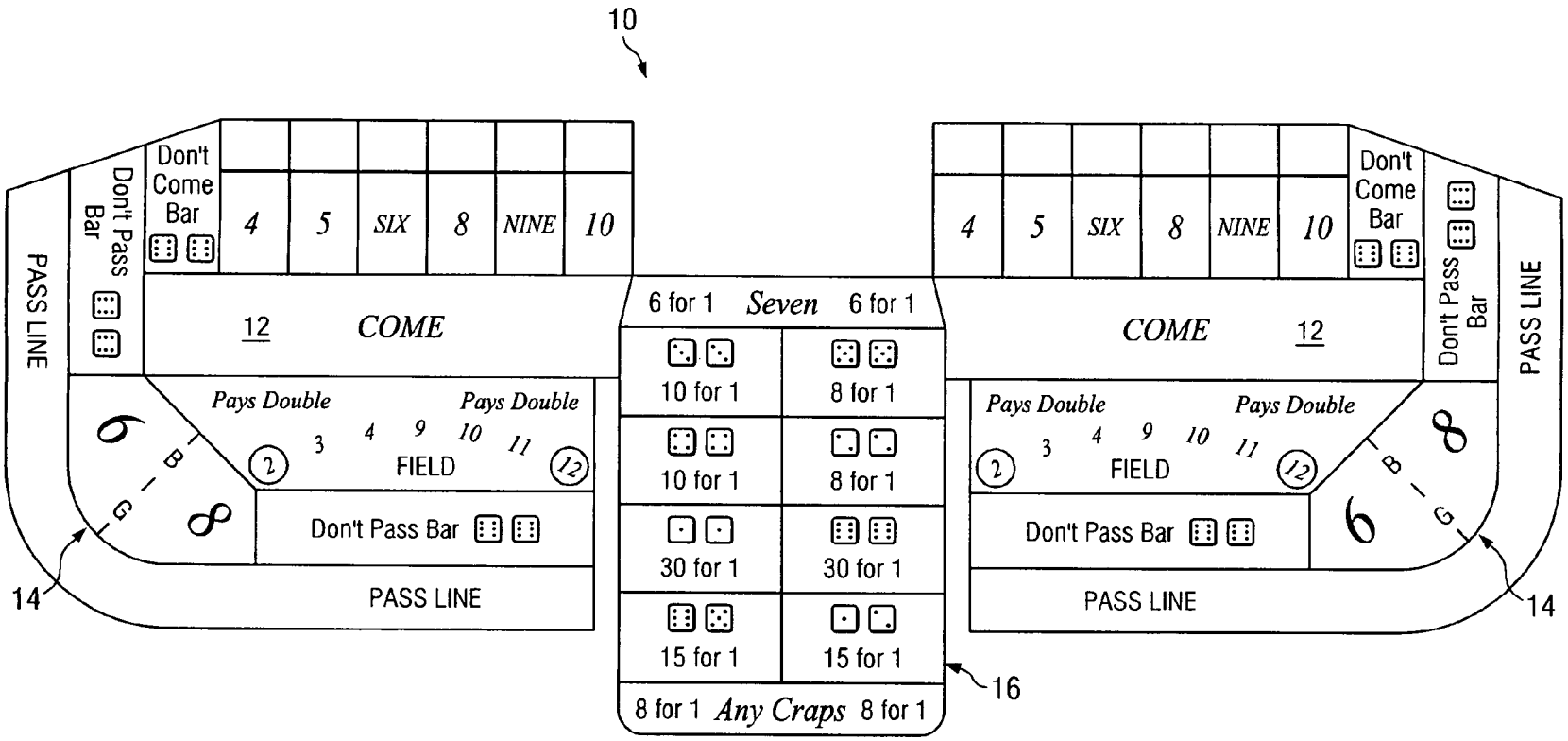
FIG. 1 (PRIOR ART)
FIG. 1 is an illustration of a prior art craps table.
Figure 2:
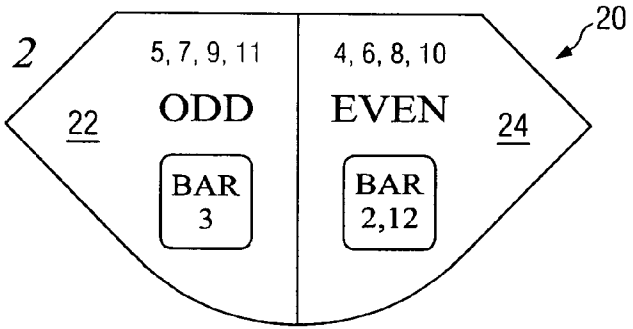
FIG. 2 is an illustration of novel craps wagering opportunities comprising the present invention.

Referring now to the Drawings, and particularly to FIG. 2, there is shown a craps table segment 20 incorporating the present invention. As will be appreciated by those skilled in the art, the craps table segment 20 is intended as a replacement for the segments 14 of the craps table 10 shown in FIG. 1 whereby the wagering opportunities afforded by means of the present invention replace the Big 6 and Big 8 wagers of a conventional craps table. Alternatively, some craps tables may already have the "Big 6" and "Big 8" betting options removed, in which case the present invention comprises additional betting opportunities than those already presented on the craps table.

The segment 20 includes an odd portion 22 and an even portion 24. By placing one or more chips on the odd portion 22, the player wagers that five, a seven, a nine, or an eleven will be thrown on the next roll of the dice during the play of the craps game. If an odd number is thrown, the player receives a payout equal to one time the original bet while retaining the original bet. If an even number is thrown, the player loses the original bet. If a three is thrown, the player does not receive a payout nor does the player lose the original bet. The bet remains for the next throw of the dice, unless the player opts to take down the bet.

By placing one or more chips on the even portion 24, the player wagers that a four, a six, an eight, or a ten will be thrown on the next roll of the dice during the play of the craps game. If an even number is thrown, the player receives a payout equal to one time the original bet while retaining the original bet. If an odd number is thrown, the player loses the original bet. If a two or a twelve is thrown, the player does not receive a payout nor does the player lose the original bet. The bet remains for the next throw of the dice, unless the player opts to take down the bet. As will therefore be understood by those skilled in the art, the bets provided to the craps player by this embodiment of the present invention resemble, in some respects, the conventional "field" bet.

Figure 3:
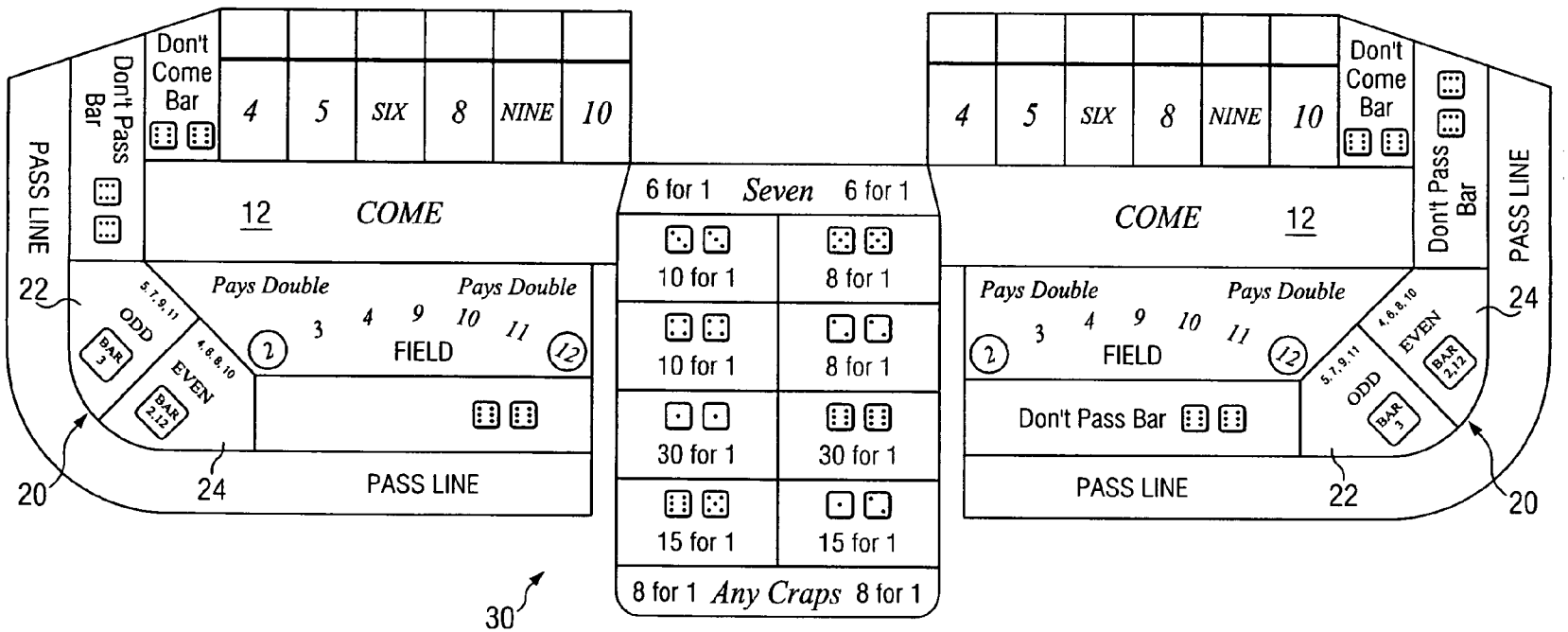
FIG. 3 is an illustration of a craps table incorporating the wagering opportunity shown in FIG. 2.

FIG. 3 shows a craps table 30 incorporating the embodiment of the present invention illustrated in FIG. 2. The craps table 30 is identical to the craps table 10 of FIG. 1 except that the craps table segment 20 shown in FIG. 2 replaces both of the craps table segments 14 shown in FIG. 1. The use of the craps table 30 of FIG. 3 is highly advantageous both to the player and to the table operator as compared with the use of the craps table 10 of FIG. 1. With respect to the craps player, the use of the segment 20 and the wagering opportunities afforded by means of the present invention provides better odds and more payout opportunities. With respect to the craps table operator, the use of the segment 20 and the wagering opportunities of the present invention attracts more players to the craps table which ultimately results in a larger return to the table operator.

Figure 4:
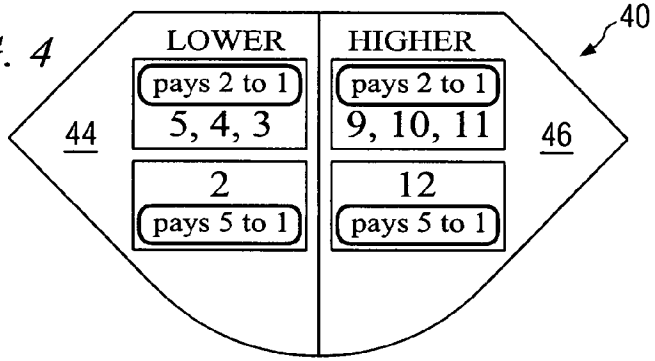
FIG. 4 is an illustration of another novel craps wagering opportunities comprising the present invention.

FIG. 4 shows a craps table segment 40 intended as a replacement for the segments 14 of the craps table 10 shown in FIG. 1. The segment 40 includes a low portion 44 and a high portion 46. By placing one or more chips on the low portion 44 the player wagers that a two, a three, a four, or a five will be thrown on the next roll of the dice during the play of the craps game. If a two is thrown on the next roll, the player receives a payout equal to five times the original bet while retaining the original bet. If a three, a four, or a five is thrown on the next roll, the player receives a payout equal to two times the original bet while retaining the original bet.

If a player places one or more chips on the high portion 46 of the segment 40, the player wagers that a nine, a ten, an eleven, or a twelve will be thrown on the next roll of the dice during the play of the craps game. If a twelve is thrown on the next roll during play of the craps game, the player receives a payout equal to five times the original wager while retaining the original wager. If a nine, a ten, or an eleven is thrown on the next roll during play of the craps game, the player receives a payout equal to two times the original wager while retaining the original wager. As will therefore be understood by those skilled in the art, the bets provided to the craps player by this embodiment of the present invention resemble, in some respects, the conventional "field" bet.

Figure 5:
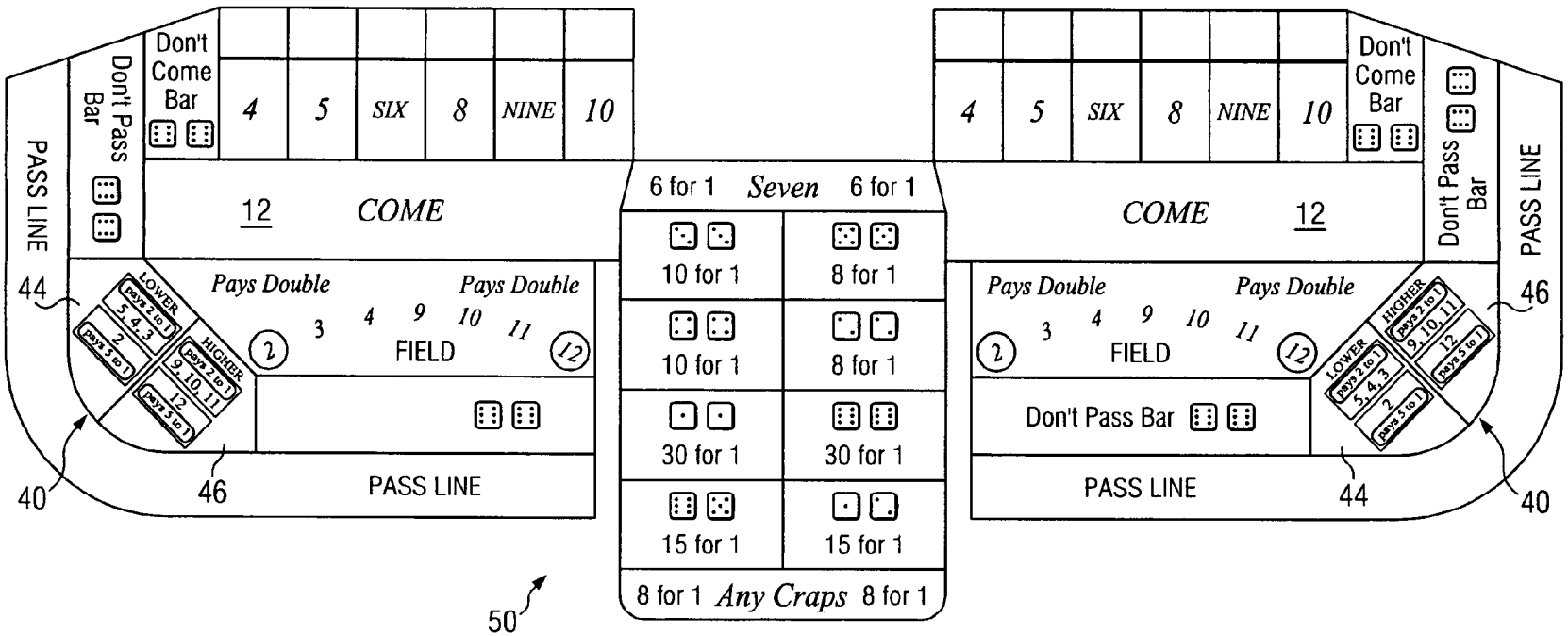
FIG. 5 is an illustration of a craps table incorporating the wagering opportunity shown in FIG. 4.

FIG. 5 shows a craps table 50 incorporating the embodiment of the present invention illustrated in FIG. 4. The craps table 50 is identical to the craps table 10 of FIG. 1 except that the craps table segment 40 shown in FIG. 4 replaces both of the craps table segments 14 shown in FIG. 1. The use of the craps table 50 of FIG. 5 is highly advantageous both to the player and to the table operator as compared with the use of the craps table 10 of FIG. 1. The advantages to both the player and table operator are substantially similar to the advantages gained by operating the craps table 30 shown in FIG. 3 described hereinabove in conjunction therewith.

Figure 6:
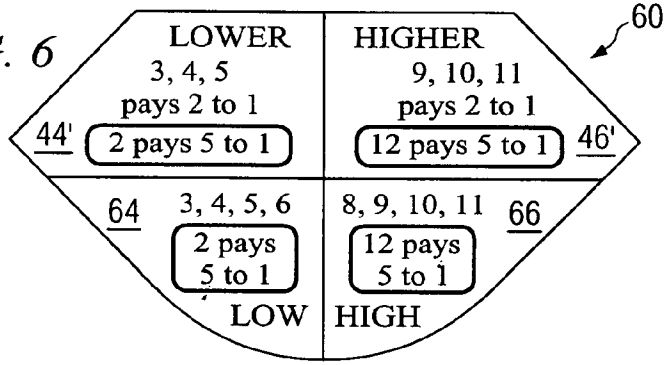
FIG. 6 is an illustration of yet another novel craps wagering opportunity comprising the present invention.

FIG. 6 shows a craps table segment 60 similar to the craps table segment 40 illustrated in FIG. 4. Many of the portions of the craps table segment 60 are substantially identical in construction and function to the segments of the craps table segment 40 illustrated in FIG. 4 described hereinabove in conjunction therewith. Such identical component parts are designated in FIG. 6 with the same reference numerals utilized above in the description of the craps table segment 60, but are differentiated therefrom by means of a prime (') designation.

The craps table segment 60 differs from the craps table segment 40 of FIG. 4 in that the craps table segment 60 offers two additional betting options. Below the low portion 44' is an alternate low portion 64 allowing the player to wager that a two, a three, a four, a five, or a six will be thrown on the next roll of the dice. If a two is thrown, the player receives a payout equal to five times the original bet while retaining the original bet. If a three, a four, a five, or a six is thrown on the next roll of the dice, the player receives a payout equal to the original bet while retaining the original bet. Below the high portion 46' is an alternate high portion 66 allowing the player to wager that an eight, a nine, a ten, an eleven, or a twelve will be thrown on the next roll of the dice. If a twelve is thrown, the player receives a payout equal to five times the original bet while retaining the original bet. If an eight, a nine, a ten, or an eleven is thrown on the next roll of the dice, the player receives a payout equal to the original bet while retaining the original bet. As will therefore be understood by those skilled in the art, the bets provided to the craps player by this embodiment of the present invention resemble, in some respects, the conventional "field" bet.

Figure 7:
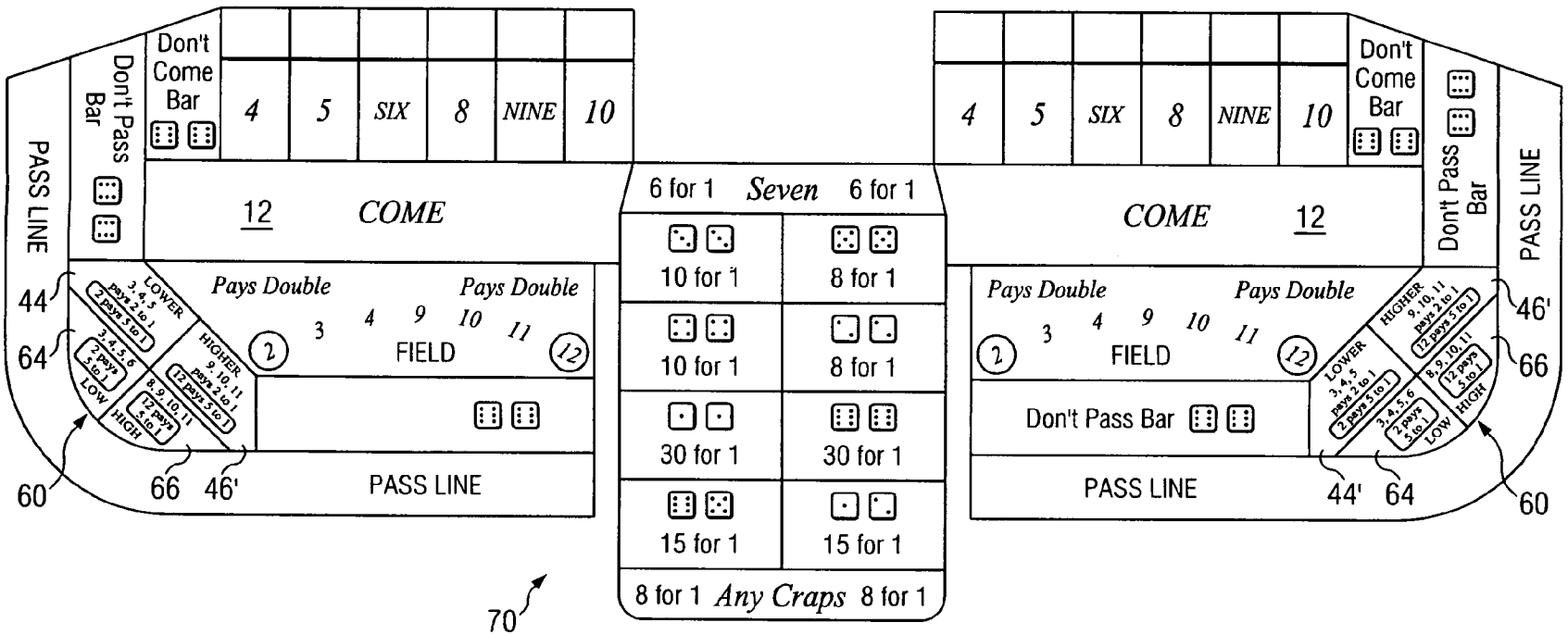
FIG. 7 is an illustration of a craps table incorporating the wagering opportunity shown in FIG. 6.

FIG. 7 shows a craps table 70 incorporating the embodiment of the present invention illustrated in FIG. 6. The craps table 70 is identical to the craps table 10 of FIG. 1 except that the craps table segment 60 shown in FIG. 6 replaces both of the craps table segments 14 shown in FIG. 1. The use of the craps table 70 of FIG. 7 is highly advantageous both to the player and to the table operator as compared with the use of the craps table 10 of FIG. 1. The advantages to both the player and table operator are substantially similar to the advantages gained by operating the craps table 30 shown in FIG. 3 described hereinabove in conjunction therewith.

Figure 8:
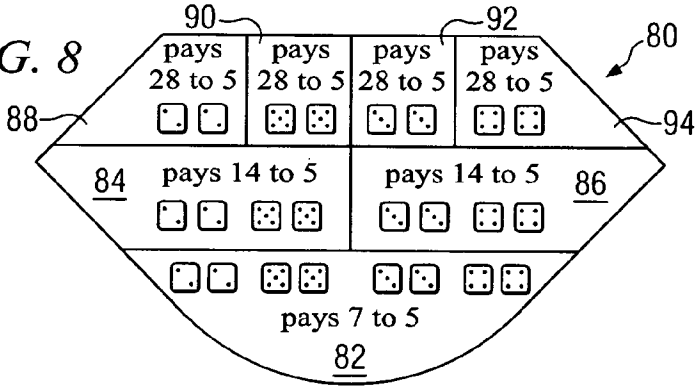
FIG. 8 is an illustration of yet another novel craps wagering opportunity comprising the present invention.

FIG. 8 shows a craps table segment 80 intended as a replacement for the segments 14 of the craps table 10 shown in FIG. 1 whereby the wagering opportunities afforded by means of the present invention replace the Big 6 and Big 8 wagers of a conventional craps table. The segment 80 includes six "Softways" segments, wherein the player can wager that a hard number will be thrown before a seven is thrown. A "Hard" number is thrown by rolling doubles. Distinct from the "Hardways" segment 16 of the craps table 10 shown in FIG. 1, the "Softways" segment allows the player to wager that a "hard" number will be thrown, but the wager is not lost if the selected number is thrown in a combination other than doubles. Specifically, the segment 80 includes a multi-number portion 82 that allows the player to wager that a double two, double three, double four, or double five, resulting in a hard four, a hard six, a hard eight, or a hard ten, will be thrown in doubles on the next roll of the dice. If doubles are thrown, the player receives a 7 to 5 payout while retaining the amount of the original bet. If a four, six, eight, or ten is thrown in a combination other than doubles, or any other number besides a seven is thrown, the player neither wins nor loses their bet. The player may keep the bet posted for the next roll of dice or opt to take the bet down. The only roll that results in the player losing the bet is if a seven is thrown.

In addition to the multi-number portion 82, the segment 80 includes a four-ten portion 84 and a six-eight portion 86. The four-ten portion 84 is similar to the multi-number portion 82 with the only difference being that the bet is narrowed to only a four or ten being thrown. Similarly, the six-eight portion 86 wagers only for a six or an eight to be thrown in doubles. For both the four-ten portion 84 and the six-eight portion 86, the player wins if the selected numbers are thrown in doubles. The payout is 14 to 5 while retaining the amount of the original bet. Finally, the segment 80 includes individual portions 88, 90, 92, and 94 for each of the hard numbers four, ten, six, and eight 94, respectively, allowing the player to wager only one number being thrown in doubles. The only roll of the dice causing a player to lose their bet on any portion of the segment 80 is a seven being thrown by the shooter. As will therefore be understood by those skilled in the art, the bets provided to the craps player by this embodiment of the present invention resemble, in some respects, the conventional "place" bet.

Figure 9:
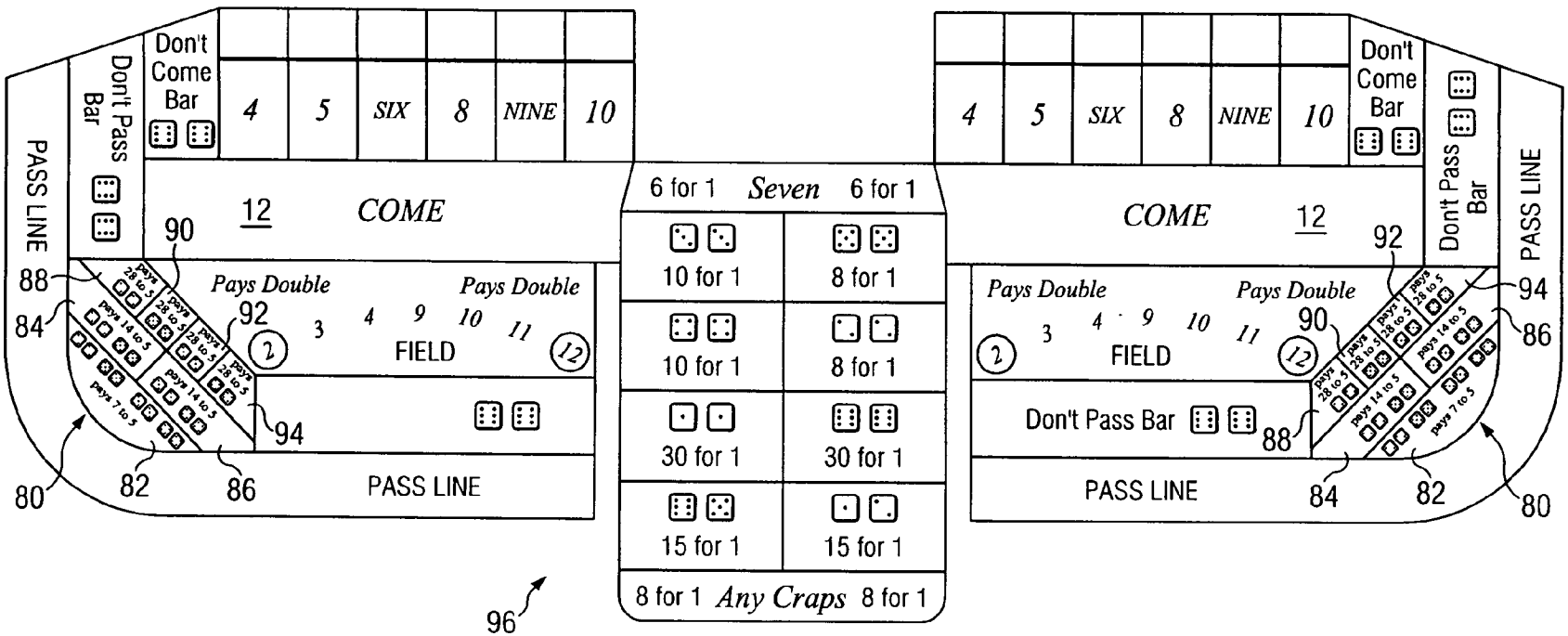
FIG. 9 is an illustration of a craps table incorporating the wagering opportunity shown in FIG. 8.

FIG. 9 shows a craps table 96 incorporating the embodiment of the present invention illustrated in FIG. 8. The craps table 96 is identical to the craps table 10 of FIG. 1 except that the craps table segment 80 shown in FIG. 8 replaces both of the craps table segments 14 shown in FIG. 1. The use of the craps table 96 of FIG. 9 is highly advantageous both to the player and to the table operator as compared with the use of the craps table 10 of FIG. 1. The advantages to both the player and table operator are substantially similar to the advantages gained by operating the craps table 30 shown in FIG. 3 described hereinabove in conjunction therewith.

Figure 10A:
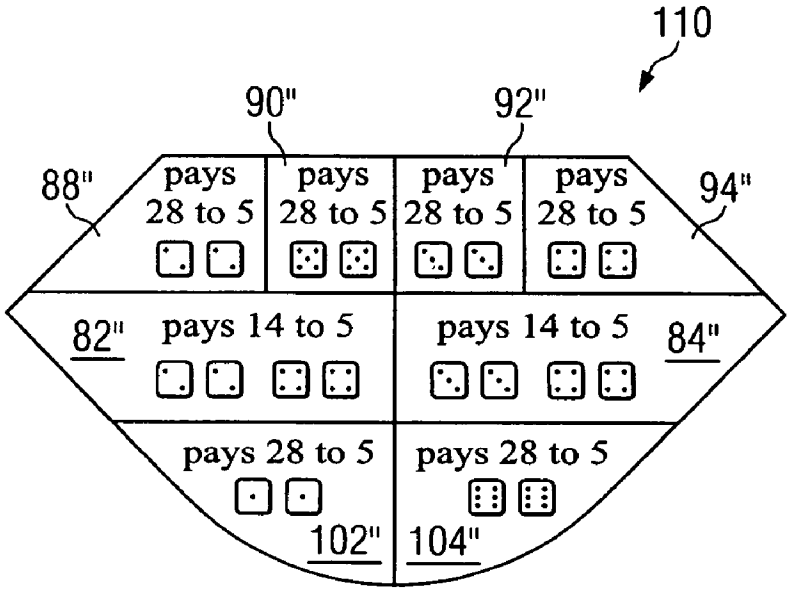
FIG. 10A is an illustration of a variation of the novel craps wagering opportunity shown in FIG. 10.
Figure 10:
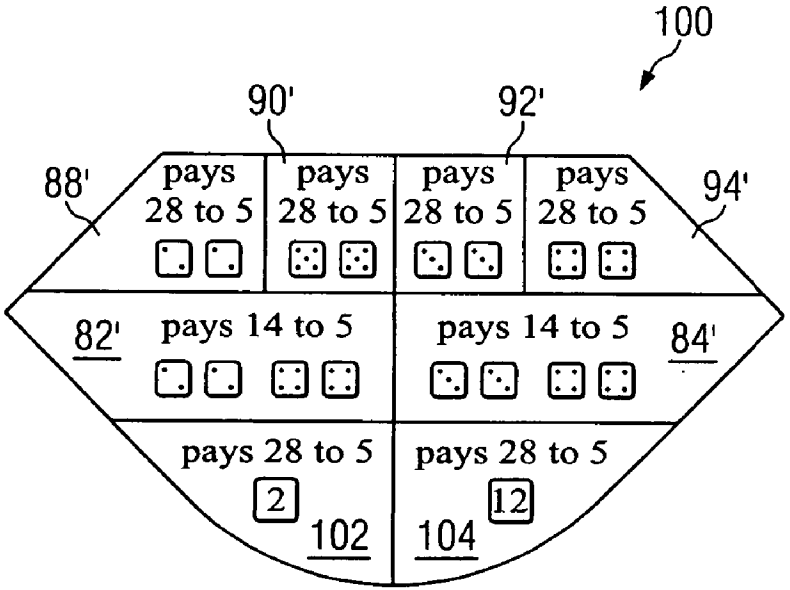
FIG. 10 is an illustration of a variation of the novel craps wagering opportunity shown in FIG. 8.

FIG. 10 shows a craps table segment 100 similar to the craps table segment 80 illustrated in FIG. 8. Many of the portions of the craps table segment 100 are substantially identical in construction and function to the portions of the craps table segment 80 illustrated in FIG. 8 described hereinabove in conjunction therewith. Such identical component parts are designated in FIG. 10 with the same reference numerals utilized above in the description of the craps table segment 80, but are differentiated therefrom by means of a prime (') designation.

The craps table segment 100 differs from the craps table segment 80 of FIG. 8 in that the craps table segment 100 offers two additional betting options. The two portion 102 allows the player to wager that the number two will be rolled via double ones before a seven is thrown. The twelve portion 104 provides the player to wager that a twelve will be rolled via double sixes before a seven is thrown. Both the two portion 102 and twelve portion 104 award a 28 to 5 payout plus the amount of the original bet if the chosen number and dice combination is thrown before the shooter throws a seven. As will therefore be understood by those skilled in the art, the bets provided to the craps player by this embodiment of the present invention resemble, in some respects, the conventional "place" bet.

FIG. 10*a* illustrates a craps table segment 110 similar to the craps table segment 100 illustrated in FIG. 10. Many of the portions of the craps table segment 110 are substantially identical in construction and function to the portions of the craps table segment 100 illustrated in FIG. 10 described hereinabove in conjunction therewith. Such identical component parts are designated in FIG. 10*a* with the same reference numerals utilized above in the description of the craps table segment 100, but are differentiated therefrom by means of a double prime (") designation. The craps table segment 110 differs from the craps table segment 100 of FIG. 10 in that the craps table segment 110 illustrates the numbers two in the two portion 102" with two die showing the number one, and the twelve portion 104" illustrates the number twelve with two die showing the number six.

Figure 11:
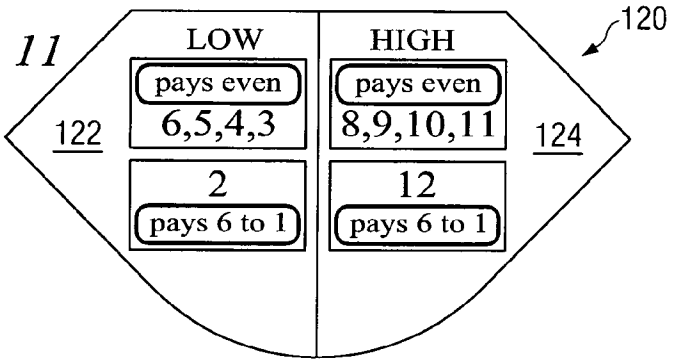
FIG. 11 is an illustration of yet another novel craps wagering opportunity comprising the present invention.

FIG. 11 shows a craps table segment 120 intended as a replacement for the segments 14 of the craps table 10 shown in FIG. 1. The segment 120 includes a low portion 122 and a high portion 124. By placing one or more chips on the low portion 122 the player wagers that a two, a three, a four, a five, or a six will be thrown on the next roll of the dice during the play of the craps game. If a two is thrown on the next roll, the player receives a payout equal to six times the original wager while retaining the original wager. If a three, a four, a five, or a six is thrown on the next roll, the player receives a payout equal to the amount of the original wager.

If a player places one or more chips on the high portion 124 of the segment 120, the player wagers that an eight, a nine, a ten, an eleven, or a twelve will be thrown on the next roll of the dice during the play of the craps game. If a twelve is thrown on the next roll during play of the craps game, the player receives a payout equal to six times the original wager while retaining the original wager. If an eight, a nine, a ten, or an eleven is thrown on the next roll during play of the craps game, the player receives a payout equal to the amount of the original wager. As will therefore be understood by those skilled in the art, the bets provided to the craps player by this embodiment of the present invention resemble, in some respects, the conventional "field" bet.

Figure 12:
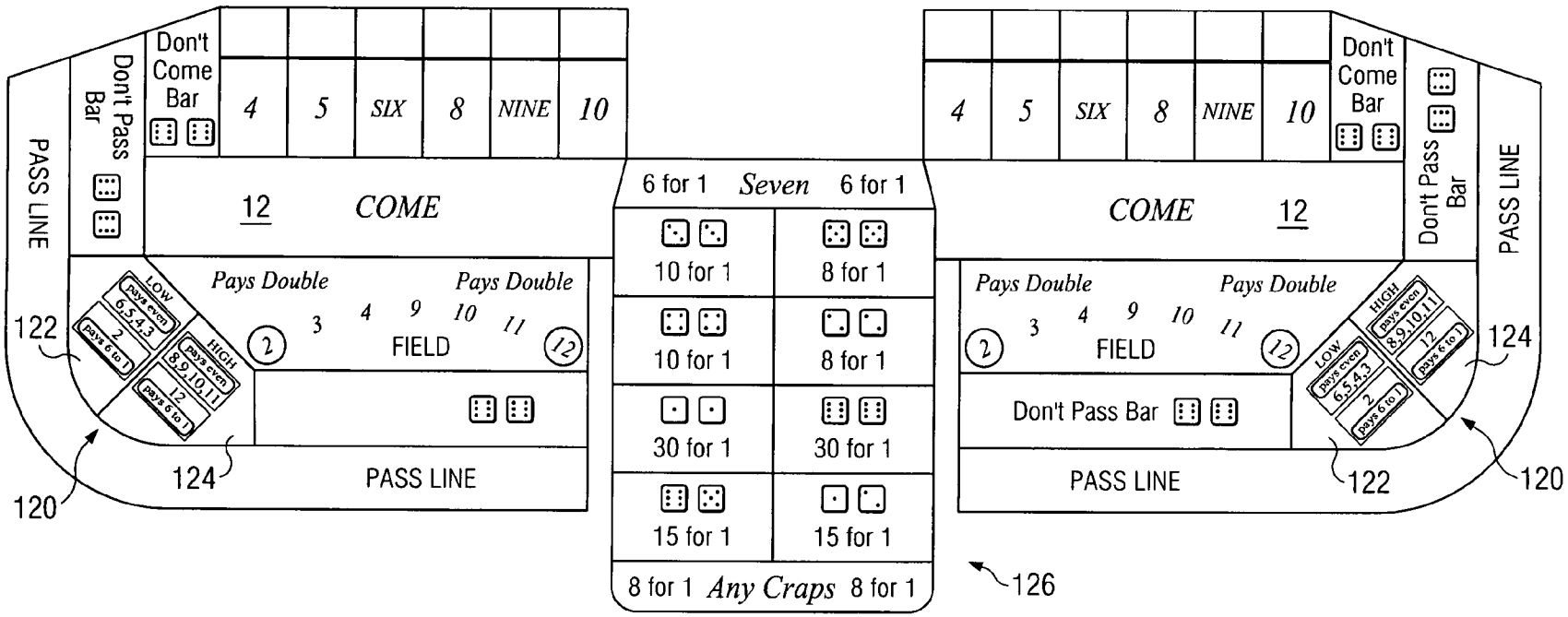
FIG. 12 is an illustration of a craps table incorporating the wagering opportunity shown in FIG. 11.

FIG. 12 shows a craps table 126 incorporating the embodiment of the present invention illustrated in FIG. 11. The craps table 126 is identical to the craps table 10 of FIG. 1 except that the craps table segment 120 shown in FIG. 11 replaces both of the craps table segments 14 shown in FIG. 1. The use of the craps table 126 of FIG. 12 is highly advantageous both to the player and to the table operator as compared with the use of the craps table 10 of FIG. 1. The advantages to both the player and table operator are substantially similar to the advantages gained by operating the craps table 30 shown in FIG. 3 described hereinabove in conjunction therewith.

Figure 13:
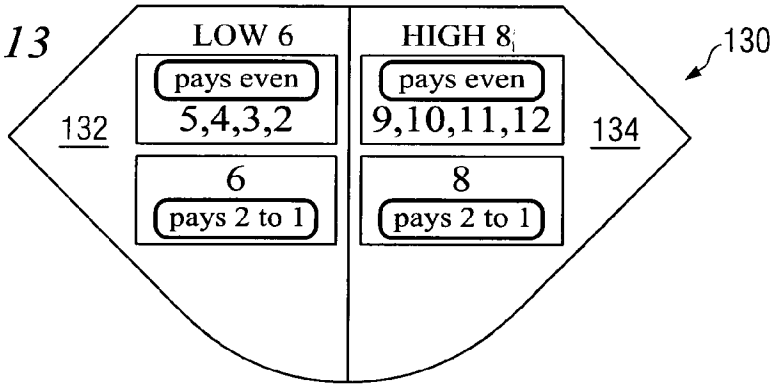
FIG. 13 is an illustration of yet another novel craps wagering opportunity comprising the present invention.

FIG. 13 shows a craps table segment 130 intended as a replacement for the segments 14 of the craps table 10 shown in FIG. 1. The segment 130 includes a low six portion 132 and a high eight portion 134. By placing one or more chips on the low six portion 132 the player wagers that a two, a three, a four, a five, or a six will be thrown on the next roll of the dice during the play of the craps game. If a six is thrown on the next roll, the player receives a payout equal to two times the original bet while retaining the original bet. If a two, three, a four, or a five is thrown on the next roll, the player receives a payout equal to the amount of the original bet.

If a player places one or more chips on the high eight portion 134 of the segment 130, the player wagers that an eight, a nine, a ten, an eleven, or a twelve will be thrown on the next roll of the dice during the play of the craps game. If an eight is thrown on the next roll during play of the craps game, the player receives a payout equal to two times the original bet while retaining the original bet. If a nine, a ten, an eleven, or a twelve is thrown on the next roll during play of the craps game, the player receives a payout equal to the amount of the original bet.

Figure 14:
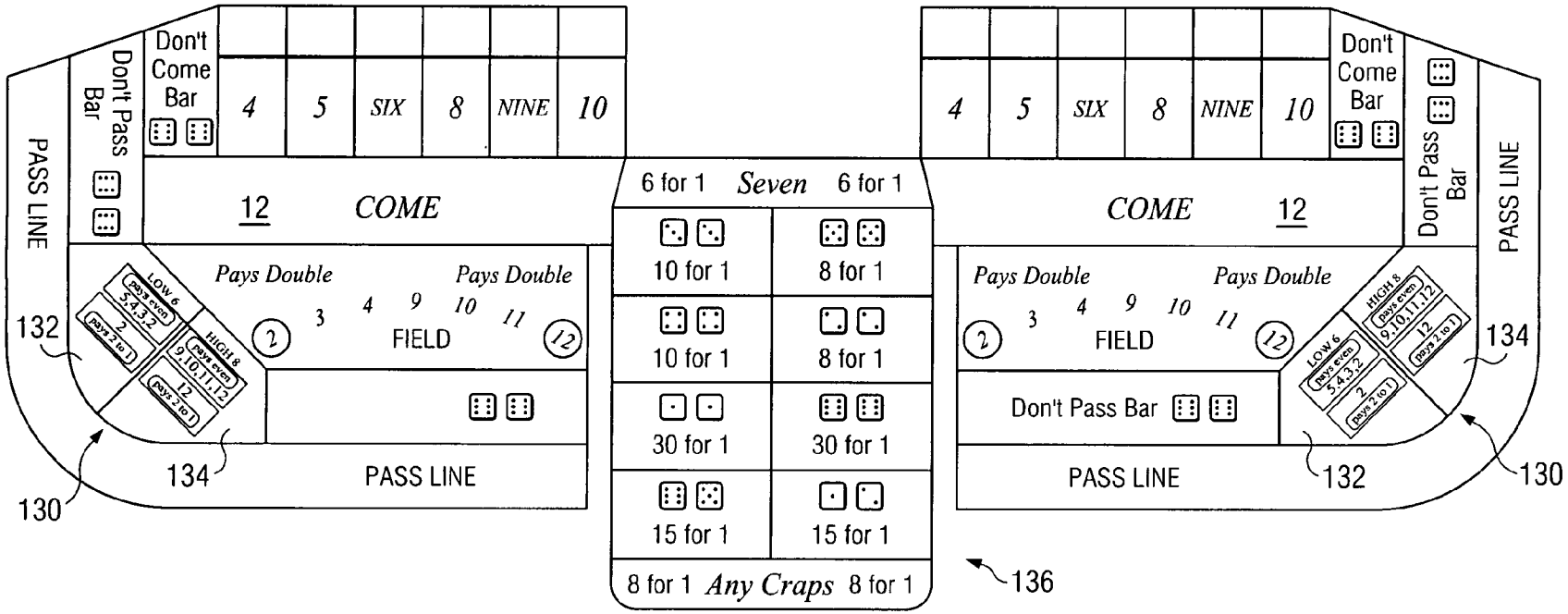
FIG. 14 is an illustration of a craps table incorporating the wagering opportunity shown in FIG. 13.

FIG. 14 shows a craps table 136 incorporating the embodiment of the present invention illustrated in FIG. 13. The craps table 136 is identical to the craps table 10 of FIG. 1 except that the craps table segment 130 shown in FIG. 13 replaces both of the craps table segments 14 shown in FIG. 1. The use of the craps table 136 of FIG. 13 is highly advantageous both to the player and to the table operator as compared with the use of the craps table 10 of FIG. 1. The advantages to both the player and table operator are substantially similar to the advantages gained by operating the craps table 30 shown in FIG. 3 described hereinabove in conjunction therewith.

Figure 15:
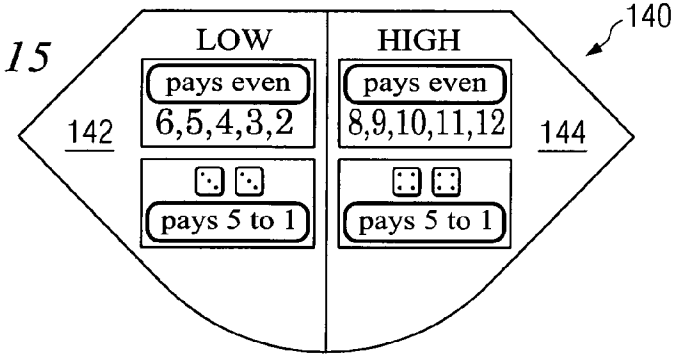
FIG. 15 is an illustration of yet another novel craps wagering opportunity comprising the present invention.

FIG. 15 shows a craps table segment 140 intended as a replacement for the segments 14 of the craps table 10 shown in FIG. 1. The segment 140 includes a low portion 142 and a high portion 144. By placing one or more chips on the low portion 142 the player wagers that a two, a three, a four, a five, or a six will be thrown on the next roll of the dice during the play of the craps game. If a six is thrown on the next roll by throwing doubles, the player receives a payout equal to five times the original bet while retaining the original bet. If a two, a three, a four, a five, or a six is thrown on the next roll, the player receives a payout equal to the amount of the original bet.

If a player places one or more chips on the high portion 144 of the segment 140, the player wagers that an eight, nine, a ten, an eleven, or a twelve will be thrown on the next roll of the dice during the play of the craps game. If an eight is thrown on the next roll by throwing doubles during play of the craps game, the player receives a payout equal to five times the original bet while retaining the original bet. If an eight, a nine, a ten, an eleven, or a twelve is thrown on the next roll during play of the craps game, the player receives a payout equal to the amount of the original bet.

Figure 16:
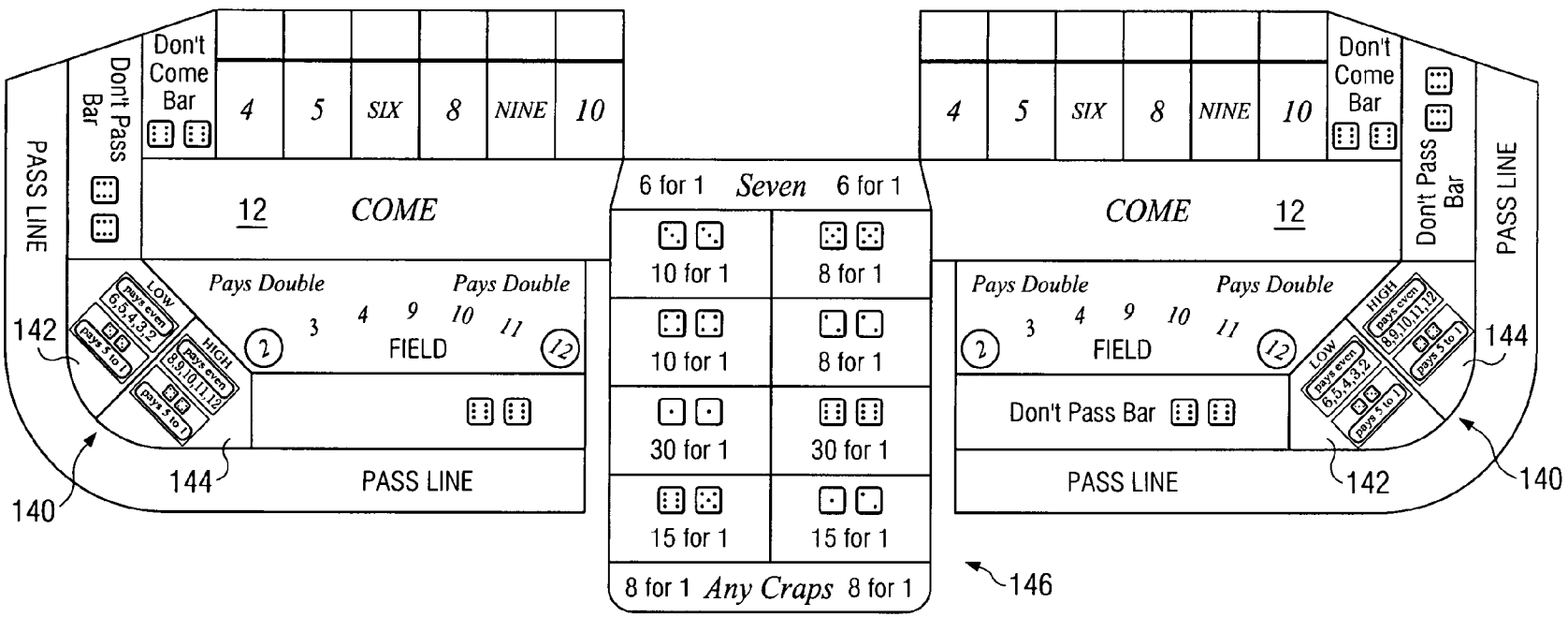
FIG. 16 is an illustration of a craps table incorporating the wagering opportunity shown in FIG. 15.

FIG. 16 shows a craps table 146 incorporating the embodiment of the present invention illustrated in FIG. 15. The craps table 146 is identical to the craps table 10 of FIG. 1 except that the craps table segment 140 shown in FIG. 15 replaces both of the craps table segments 14 shown in FIG. 1. The use of the craps table 146 of FIG. 15 is highly advantageous both to the player and to the table operator as compared with the use of the craps table 10 of FIG. 1. The advantages to both the player and table operator are substantially similar to the advantages gained by operating the craps table 30 shown in FIG. 3 described hereinabove in conjunction therewith.

Figure 17:
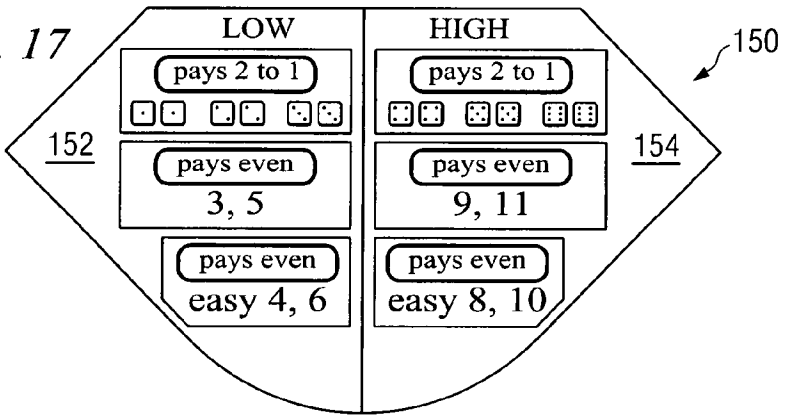
FIG. 17 is an illustration of yet another novel craps wagering opportunity comprising the present invention.

FIG. 17 shows a craps table segment 150 intended as a replacement for the segments 14 of the craps table 10 shown in FIG. 1. The segment 150 includes a low portion 152 and a high portion 154. By placing one or more chips on the low portion 152 the player wagers that a two, a three, a four, a five, or a six will be thrown on the next roll of the dice during the play of the craps game. If a two, a four, or a six is thrown on the next roll by throwing doubles, the player receives a payout equal to two times the original bet while retaining the original bet. If a three or a five is thrown on the next roll, the player receives a payout equal to the amount of the original bet. If a four or a six is thrown on the next roll in a form other than by throwing doubles, the player receives a payout equal to the amount of the original bet.

If a player places one or more chips on the high portion 154 of the segment 150, the player wagers that an eight, a nine, a ten, an eleven, or a twelve will be thrown on the next roll of the dice during the play of the craps game. If an eight, a ten, or twelve is thrown on the next roll by throwing doubles, the player receives a payout equal to two times the original bet while retaining the original bet. If a nine or an eleven is thrown on the next roll, the player receives a payout equal to the amount of the original bet. If an eight or a ten is thrown on the next roll in a form other than by throwing doubles, the player receives a payout equal to the amount of the original bet.

Figure 18:
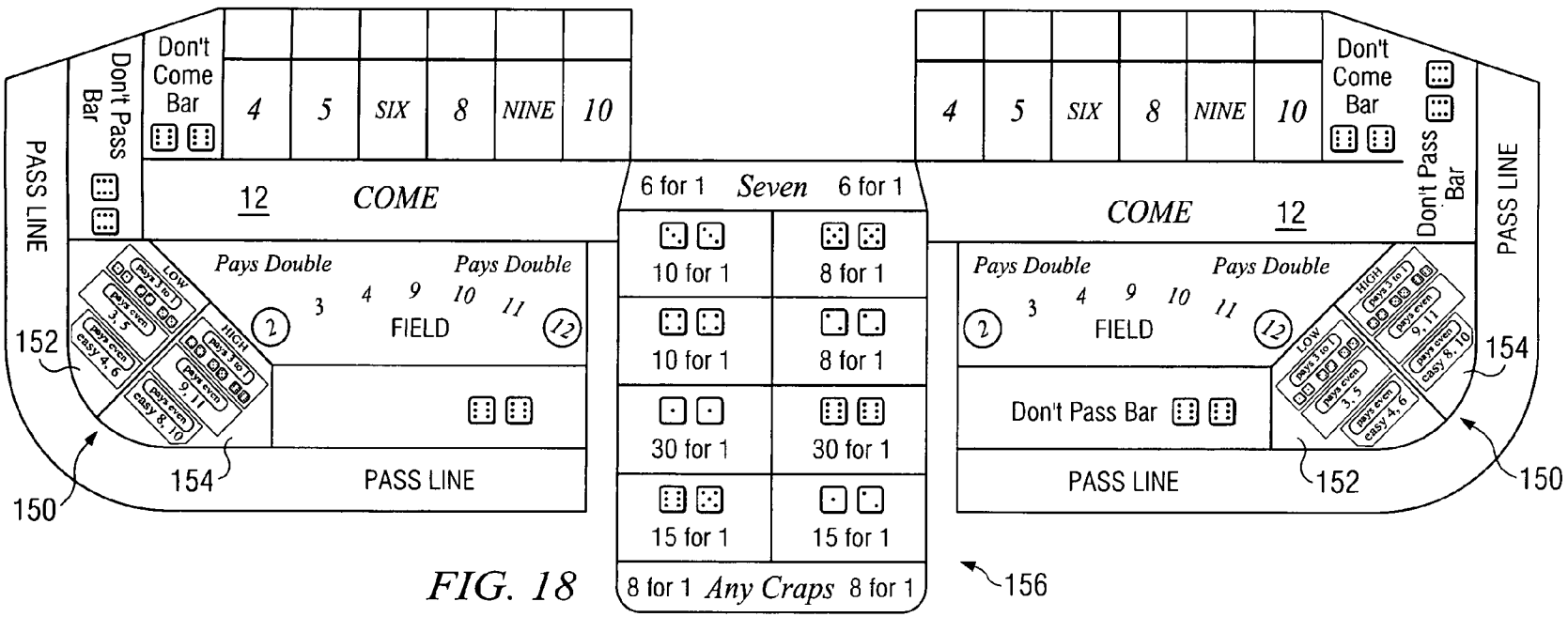
FIG. 18 is an illustration of a craps table incorporating the wagering opportunity shown in FIG. 17.

FIG. 18 shows a craps table 156 incorporating the embodiment of the present invention illustrated in FIG. 17. The craps table 156 is identical to the craps table 10 of FIG. 1 except that the craps table segment 150 shown in FIG. 17 replaces both of the craps table segments 14 shown in FIG. 1. The use of the craps table 156 of FIG. 17 is highly advantageous both to the player and to the table operator as compared with the use of the craps table 10 of FIG. 1. The advantages to both the player and table operator are substantially similar to the advantages gained by operating the craps table 30 shown in FIG. 3 described hereinabove in conjunction therewith.

Although the present invention is described in conjunction with a game of chance played using a pair of dice, the present invention is equally applicable to a craps game of chance played with playing cards instead of dice wherein the player's wager and payout depend on the next cards dealt rather than the next roll of the dice.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. A method of gaming comprising the steps of:

providing a pair of dice:

providing a traditional craps table having a playing surface comprising a plurality of segments defining a plurality of wagering opportunities including:

a Pass Line segment for securing a wager betting both that one or more rolls of the dice will yield an established first point without rolling a seven, and a prior number is rolled prior to rolling a first point number;

a Don't Pass Bar segment for securing a wager betting that a seven will be rolled before an established first point number is rolled;

a Come segment for receiving a wager betting that the first number rolled after the come bet is placed will be rolled again before a seven is rolled;

a Don't Come Bar segment for receiving a wager betting that a seven will be rolled before the first number rolled after the don't come bet is placed is rolled again;

a plurality of Place Bet segments each identified with one of the numbers 4,5,6,8,9, or 10 for receiving a wager that the number associated with the segment will be thrown before a seven is thrown;

at least one Field segment for securing a wager betting that a number selected from the group consisting of the numbers 2,3,4,9,10,11, and 12 will be thrown on the next roll;

a Hard Ways segment for receiving a wager betting that a pair of twos, a pair of threes, a pair of fours, or a pair of fives will be thrown before a seven is thrown and before the selected number is thrown in a non-pair combinations;

a Big Six segment for receiving a wager betting that the next roll will yield a six; and a Big Eight segment for receiving a wager betting that the next roll will yield an eight;

wherein a new segment having at least one wagering opportunity replaces the Big 6 and the Big 8 segments of the traditional craps table bet, the new segment comprising:

a) a first wagering opportunity to place only one bet that any one of only a two or three, four, or five will be thrown on the next roll of the dice during the play of a craps game; and b) a second wagering opportunity to place only one bet that any one of only a nine, ten, eleven, or twelve will be thrown on a next roll of the dice during the play of a craps game;

placing a bet on any one of the plurality of segments;

after placing the bet, rolling the pair of dice;

determining the outcome of the roll of the dice; and paying an amount of winnings to a player placing a winner wager on at least one of the wagering opportunities within the new segment.

2. A method of gaming comprising the steps of:

providing a pair of dice;

providing a traditional craps table having a playing surface comprising a plurality of segments defining a plurality of wagering opportunities including:

a Pass Line segment for securing a wager betting both that one or more rolls of the dice will yield an established first point without rolling a seven, and a prior number is rolled prior to rolling a first point number;

a Don't Pass Bar segment for securing a wager betting that a seven will be rolled before an established first point number is rolled;

a Come segment for receiving a wager betting that the first number rolled after the come bet is placed will be rolled again before a seven is rolled;

a Don't Come Bar segment for receiving a wager betting that a seven will be rolled before the first number rolled after the don't come bet is placed is rolled again;

a plurality of Place Bet segments each identified with one of the numbers 4,5,6,8,9, or 10 for receiving a wager that the number associated with the segment will be thrown before a seven is thrown;

at least one Field segment for securing a wager betting that a number selected from the group consisting of the numbers 2,3,4,9,10,11, and 12 will be thrown on the next roll;

a Hard Ways segment for receiving a wager betting that a pair of twos, a pair of threes, a pair of fours, or a pair of fives will be thrown before a seven is thrown and before the selected number is thrown in a non-pair combinations;

a Big Six segment for receiving a wager betting that the next roll will yield a six; and a Big Eight segment for receiving a wager betting that the next roll will yield an eight;

wherein a new segment having at least one wagering opportunity replaces the Big 6 and the Big 8 segments of the traditional craps table bet, the new segment comprising:

a) a first wagering opportunity to place only one wager that any one of only a two, three, four, five, or six will be thrown on a next roll of the dice during the play of a craps game;

b) a second wagering opportunity to place only one wager that any one of only a two, three, four, or five will be thrown on a next roll of the dice during the play of a craps game;

c) a third wagering opportunity to place only one wager that any one of only an eight, nine, ten, eleven, or twelve will be thrown on a next roll of the dice during the play of a craps game; and d) a fourth wagering opportunity to place only one wager that any one of only a nine, ten, eleven or twelve will be thrown on a next roll of the dice during the play of a craps game;

placing a bet on any of the plurality of segments;

after placing the bet, rolling the pair of dice;

determining the outcome of the roll of the dice; and paying an amount of winnings to a player placing a winning wager on at least one of the wagering opportunities within the new segment.

3. A method of gaming comprising the steps of:

providing a pair of dice;

providing a traditional craps table having a playing surface comprising a plurality of segments defining a plurality of wagering opportunities including:

a Pass Line segment for securing a wager betting both that one or more rolls of the dice will yield an established first point without rolling a seven, and a prior number is rolled prior to rolling a first point number;

a Don't Pass Bar segment for securing a wager betting that a seven will be rolled before an established first point number is rolled;

a Come segment for receiving a wager betting that the first number rolled after the come bet is placed will be rolled again before a seven is rolled;

a Don't Come Bar segment for receiving a wager betting that a seven will be rolled before the first number rolled after the don't come bet is placed is rolled again;

a plurality of Place Bet segments each identified with one of the numbers 4,5,6,8,9, or 10 for receiving a wager that the number associated with the segment will be thrown before a seven is thrown;

at least one Field segment for securing a wager betting that a number selected from the group consisting of the numbers 2,3,4,9,10,11, and 12 will be thrown on the next roll;

a Hard Ways segment for receiving a wager betting that a pair of twos, a pair of threes, a pair of fours, or a pair of fives will be thrown before a seven is thrown and before the selected number is thrown in a non-pair combinations;

a Big Six segment for receiving a wager betting that the next roll will yield a six; and a Big Eight segment for receiving a wager betting that the next roll will yield an eight;

wherein a new segment having at least one wagering opportunity replaces the Big 6 and the Big 8 segments of the traditional craps table bet ,the new segment comprising:

a) a first wagering opportunity to place only one wager that any one of only a four, six, eight, or ten will be thrown in doubles before a seven is thrown during the play of a craps game;

b) a second wagering opportunity to place only one wager that any one of only a four or ten will be thrown in doubles before a seven is thrown during the play of a craps game;

c) a third wagering opportunity to place only one wager that any one of only a six or eight will be thrown in doubles before a seven is thrown during the play of a craps game;

d) a fourth wagering opportunity to wager that a four will be thrown in doubles a before a seven is thrown during the play of a craps game;

e) a fifth wagering opportunity to wager that a six will be thrown in doubles a before a seven is thrown during the play of a craps game;

f) a sixth wagering opportunity to wager that an eight will be thrown in doubles a before a seven is thrown during the play of a craps game; and g) a seventh wagering opportunity to wager that a ten will be thrown in doubles a before a seven is thrown during the play of a craps game;

placing a bet on any one of the plurality of segments;

after placing the bet, rolling the pair of dice;

determining the outcome of the roll of the dice;

giving the player a choice to maintain the original bet on one or more of the wagering opportunities within the new segment if a seven is not thrown on the next roll of dice or a number on which the player has wagered is thrown in a form other than doubles; and paying an amount of winnings to a player placing a winning wager on at least one of the wagering opportunities within the new segment.

4. A method of gaming comprising the steps of:

providing a pair of dice;

providing a traditional craps table having a playing surface comprising a plurality of segments defining a plurality of wagering opportunities including:

a Pass Line segment for securing a wager betting both that one or more rolls of the dice will yield an established first point without rolling a seven, and a prior number is rolled prior to rolling a first point number;

a Don't Pass Bar segment for securing a wager betting that a seven will be rolled before an established first point number is rolled;

a Come segment for receiving wager betting that the first number rolled after the come bet is placed will be rolled again before a seven is rolled;

a Don't Come Bar segment for receiving a wager betting that a seven will be rolled before the first number rolled after the don't come bet is placed is rolled again;

a plurality of Place Bet segments each identified with one of the numbers 4,5,6,8,9, or 10 for receiving a wager that the number associated with the segment will be thrown before a seven is thrown;

at least one Field segment for securing a wager betting that a number selected from the group consisting of the numbers 2,3,4,9,10,11, and 12 will be thrown on the next roll;

a Hard Ways segment for receiving a wager betting that a pair of twos, a pair of threes, a pair of fours, or a pair of fives will be thrown before a seven is thrown and before the selected number is thrown in a non-pair combinations;

a Big Six segment for receiving a wager betting that the next roll will yield a six; and a Big Eight segment for receiving a wager betting that the next roll will yield an eight;

wherein a new segment having at least one wagering opportunity replaces the Big 6 and the Big 8 segments of the traditional craps table bet ,the new segment comprising:

a) a first wagering opportunity to wager that a two will be thrown before a seven is thrown during the play of a craps game;

b) a second wagering opportunity to wager that a twelve will be thrown in doubles before a seven is thrown during the play of a craps game;

c) a third wagering opportunity to place only one wager that any one of only a four or eight will be thrown in doubles before a seven is thrown during the play of a craps game;

d) a fourth wagering opportunity to place only one wager that any one of only a six or eight will be thrown in doubles before a seven is thrown during the play of a craps game;

e) a fifth wagering opportunity to wager that a four will be thrown in doubles a before a seven is thrown during the play of a craps game;

f) a sixth wagering opportunity to wager that a six will be thrown in doubles a before a seven is thrown during the play of a craps game;

g) a seventh wagering opportunity to wager that an eight will be thrown in doubles a before a seven is thrown during the play of a craps game; and h) an eighth wagering opportunity to wager that a ten will be thrown in doubles a before a seven is thrown during the play of a craps game;

placing a bet on any of the plurality of segments;

after placing the bet, rolling the pair of dice;

determining the outcome of the roll of the dice;

giving the player a choice to maintain the original bet on one or more of the wagering opportunities within the new segment if a seven is not thrown on the next roll of dice or a number on which the player has wagered is thrown in a form other than doubles; and paying an amount of winnings to a player placing a winning wager on at least one of the wagering opportunities within the new segment.

5. A method of gaming comprising the steps of:

providing a pair of dice:

providing traditional a craps table having a playing surface comprising a plurality of segments defining a plurality of wagering opportunities including:

a Pass Line segment for securing a wager betting both that one or more rolls of the dice will yield an established first point without rolling a seven, and a prior number is rolled prior to rolling a first point number;

a Don't Pass Bar segment for securing a wager betting that a seven will be rolled before an established first point number is rolled;

a Come segment for receiving a wager betting that the first number rolled after the come bet is placed will be rolled again before a seven is rolled;

a Don't Come Bar segment for receiving a wager betting that a seven will be rolled before the first number rolled after the don't come bet is placed is rolled again;

a plurality of Place Bet segments each identified with one of the numbers 4,5,6,8,9, or 10 for receiving a wager that the number associated with the segment will be thrown before a seven is thrown;

at least one Field segment for securing a wager betting that a number selected from the group consisting of the numbers 2,3,4,9,10,11, and 12 will be thrown on the next roll;

a Hard Ways segment for receiving a wager betting that a pair of twos, a pair of threes, a pair of fours, or a pair of fives will be thrown before a seven is thrown and before the selected number is thrown in a non-pair combinations;

a Big Six segment for receiving a wager betting that the next roll will yield a six; and a Big Eight segment for receiving a wager betting that the next roll will yield an eight;

wherein a new segment having at least one wagering opportunity replaces the Big 6 and the Big 8 segments of the traditional craps table bet, the new segment comprising:

a) a first wagering opportunity to place only one wager that any one of only a two, three, four, five, or six will be thrown on a next roll of the dice during the play of a craps game; and b) a second wagering opportunity to place only one wager that any one of only an eight, nine, ten, eleven, or twelve will be thrown on a next roll of the dice during the play of a craps game;

placing a bet on any of the plurality of segments;

after placing the bet, rolling the pair of dice;

determining the outcome of the roll of the dice; and paying an amount of winnings to a player placing a winning wager on at least one of the wagering opportunities within the new segment.

6. A method of gaming comprising the steps of:

providing a pair of dice;

providing traditional a craps table having a playing surface comprising a plurality of segments defining a plurality of wagering opportunities including:

a Pass Line segment for securing a wager betting both that one or more rolls of the dice will yield an established first point without rolling a seven, and a prior number is rolled prior to rolling a first point number;

a Don't Pass Bar segment for securing a wager betting that a seven will be rolled before an established first point number is rolled;

a Come segment for receiving a wager betting that the first number rolled after the come bet is placed will be rolled again before a seven is rolled;

a Don't Come Bar segment for receiving a wager betting that a seven will be rolled before the first number rolled after the don't come bet is placed is rolled again;

a plurality of Place Bet segments each identified with one of the numbers 4,5,6,8,9, or 10 for receiving a wager that the number associated with the segment will be thrown before a seven is thrown;

at least one Field segment for securing a wager betting that a number selected from the group consisting of the numbers 2,3,4,9,10,11, and 12 will be thrown on the next roll;

a Hard Ways segment for receiving a wager betting that a pair of twos, a pair of threes, a pair of fours, or a pair of fives will be thrown before a seven is thrown and before the selected number is thrown in a non-pair combinations;

a Big Six segment for receiving a wager betting that the next roll will yield a six; and a Big Eight segment for receiving a wager betting that the next roll will yield an eight;

wherein a new segment having at least one wagering opportunity replaces the Big 6 and the Big 8 segments of the traditional craps table bet, the new segment comprising:

a) a first wagering opportunity to place only one wager that any one of only a two, three, four, five, or six will be thrown on a next roll of the dice during the play of a craps game and that the six will be thrown in doubles; and b) a second wagering opportunity to place only one wager that any one of only an eight, nine, ten, eleven, or twelve will be thrown on a next roll of the dice during the play of a craps game and that the eight will be thrown in doubles;

placing a bet on any one of the plurality of segments;

after placing the bet, rolling the pair of dice;

determining the outcome of the roll of the dice; and paying an amount of winnings to a player placing a winning wager on at least one of the wagering opportunities within the new segment.

7. A method of gaming comprising the steps of:

providing a pair of dice;

providing a traditional craps table having a playing surface comprising a plurality of segments defining a plurality of wagering opportunities including:

a Pass Line segment for securing a wager betting both that one or more rolls of the dice will yield an established first point without rolling a seven, and a prior number is rolled prior to rolling a first point number;

a Don't Pass Bar segment for securing a wager betting that a seven will be rolled before an established first point number is rolled;

a Come segment for receiving a wager betting that the first number rolled after the come bet is placed will be rolled again before a seven is rolled;

a Don't Come Bar segment for receiving a wager betting that a seven will be rolled before the first number rolled after the don't come bet is placed is rolled again;

a plurality of Place Bet segments each identified with one of the numbers 4,5,6,8,9, or 10 for receiving a wager that the number associated with the segment will be thrown before a seven is thrown;

at least one Field segment for securing a wager betting that a number selected from the group consisting of the numbers 2,3,4,9,10,11, and 12 will be thrown on the next roll;

a Hard Ways segment for receiving a wager betting that a pair of twos, a pair of threes, a pair of fours, or a pair of fives will be thrown before a seven is thrown and before the selected number is thrown in a non-pair combinations;

a Big Six segment for receiving a wager betting that the next roll will yield a six; and a Big Eight segment for receiving a wager betting that the next roll will yield an eight;

wherein a new segment having at least one wagering opportunity replaces the Big 6 and the Big 8 segments of the traditional craps table bet, the new segment comprising:

a) a first wagering opportunity to place only one wager that any one of only a two, three, four, five, or six will be thrown on a next roll of the dice during the play of a craps game and that the two, four, or six will be thrown in doubles; and b) a second wagering opportunity to place only one wager that any one of only an eight, nine, ten, eleven, or twelve will be thrown on a next roll of the dice during the play of a craps game and that the eight, ten, or twelve will be thrown in doubles;

placing a bet on any of the plurality of segments;

after placing the bet, rolling the pair of dice;

determining the outcome of the roll of the dice; and paying an amount of winnings to a player placing a winning wager on at least one of the wagering opportunities within the new segment.

* * * * *

UNITED STATES PATENT AND TRADEMARK OFFICE

CERTIFICATE OF CORRECTION

PATENT NO. : 7,413,193 B2
APPLICATION NO. : 11/292663
DATED : August 19, 2008
INVENTOR(S) : Clay T. Cacas It is certified that error appears in the above-identified patent and that said Letters Patent is hereby corrected as shown below:

IN THE REFERENCES CITED

For Patent No. 4,506,890, line 2, replace "Murry" with --Murray--.

Please add the following cited references that were left out:

| Doc. No. | Date | Name | Class | Subclass |
|---|---|---|---|---|
| 6,655,689 | 12/02/2003 | Stasi | 273 | 274 |
| 7,100,919 | 9/05/2006 | Stasi | 273 | 274 |
| 7,255,350 | 8/14/2007 | Timmons | 273 | 274 |
| 7,229,352 | 6/12/2007 | Bonito | 463 | 22 |
| 6,805,352 | 10/19/2004 | Hunter | 273 | 274 |
| 6,601,848 | 8/05/2003 | Timmons | 273 | 146 |
| 7,341,519 | 3/11/2008 | McMain | 463 | 25 |
| 7,309,066 | 12/18/2007 | Donaldson | 273 | 292 |
| 7,331,860 | 2/19/2008 | Hermann | 463 | 16 |
| 7,335,103 | 2/26/2008 | Seelig | 463 | 22 |
| D522,069 | 5/30/2006 | Stasi | D21 | 354 |
| D570,419 | 6/03/2008 | Stasi | D21 | 369 |

Col. 5, line 30, replace "four, six, eight or ten" with --four, a six, an eight or a ten--.
Col. 5, line 40, replace "a four or ten" with --a four or a ten--.

Claim 1, Col. 9, lines 18-19, replace "non-pair combinations" with --non-pair combination--.
Claim 2, Col. 10, lines 4-5, replace "non-pair combinations" with --non-pair combination--.
Claim 3, Col. 10, lines 66-67, replace "non-pair combinations" with --non-pair combination--.
Claim 3, Col. 11, line 22, replace "thrown in doubles a" with --thrown in doubles--.
Claim 3, Col. 11, line 25, replace thrown in doubles a" with --thrown in doubles--.
Claim 3, Col. 11, line 29, replace "thrown in doubles a" with --thrown in doubles--.
Claim 3, Col. 11, line 32, replace "thrown in doubles a" with --thrown in doubles--.
Claim 4, Col. 12, lines 8-9, replace "non-pair combinations" with --non-pair combination--.
Claim 4, Col. 12, line 33, replace "thrown in doubles a" with --thrown in doubles--.
Claim 4, Col. 12, line 36, replace "thrown in doubles a" with --thrown in doubles--.

UNITED STATES PATENT AND TRADEMARK OFFICE

CERTIFICATE OF CORRECTION

PATENT NO. : 7,413,193 B2
APPLICATION NO. : 11/292663
DATED : August 19, 2008
INVENTOR(S) : Clay T. Cacas It is certified that error appears in the above-identified patent and that said Letters Patent is hereby corrected as shown below:

Claim 4, Col. 12, line 39, replace "thrown in doubles a" with --thrown in doubles--.
Claim 4, Col. 12, line 43, replace "thrown in doubles a" with --thrown in doubles--.
Claim 5, Col. 12, line 58, replace "traditional a craps" with --a traditional craps--.
Claim 5, Col. 13, lines 18-19, replace "non-pair combinations" with --non-pair combination--.
Claim 6, Col. 13, line 44, replace "traditional a craps" with --a traditional craps--.
Claim 6, Col. 14, lines 4-5, replace "non-pair combinations" with --non-pair combination--.
Claim 7, Col. 14, lines 58-59, replace "non-pair combinations" with --non-pair combination--.

Signed and Sealed this

Twenty-fourth Day of March, 2009

John Doll

JOHN DOLL
*Acting Director of the United States Patent and Trademark Office*